US010856719B2

(12) United States Patent
Dirschus et al.

(10) Patent No.: US 10,856,719 B2
(45) Date of Patent: Dec. 8, 2020

(54) CLEANING DEVICE AND METHOD FOR CLEANING ARTICLES TO BE CLEANED

(71) Applicant: MEIKO Maschinenbau GmbH & Co. KG, Offenburg (DE)

(72) Inventors: Jürgen Dirschus, Schutterwald (DE); Phillip Huber, Oberkirch (DE); Stefan Kolb, Offenburg (DE); Thomas Loos, Hohberg (DE); Thomas Nager, Offenburg (DE); Thomas Peukert, Bühl (DE); Marijan Simundic, Ohlsbach (DE)

(73) Assignee: MEIKO MASCHINENBAU GMBH & CO. KG, Offenburg (DE)

( * ) Notice: Subject to any disclaimer, the term of this patent is extended or adjusted under 35 U.S.C. 154(b) by 0 days.

(21) Appl. No.: 16/484,789

(22) PCT Filed: Feb. 7, 2018

(86) PCT No.: PCT/EP2018/053066
§ 371 (c)(1),
(2) Date: Aug. 8, 2019

(87) PCT Pub. No.: WO2018/146143
PCT Pub. Date: Aug. 16, 2018

(65) Prior Publication Data

US 2020/0000308 A1 Jan. 2, 2020

(30) Foreign Application Priority Data

Feb. 9, 2017 (DE) ..... 10 2017 202 055

(51) Int. Cl.
*A47L 15/00* (2006.01)
*G07F 17/20* (2006.01)

(52) U.S. Cl.
CPC ..... *A47L 15/0076* (2013.01); *A47L 15/0018* (2013.01); *G07F 17/20* (2013.01)

(58) Field of Classification Search
None
See application file for complete search history.

(56) References Cited

U.S. PATENT DOCUMENTS 4,076,554 A 2/1978 Weihe

FOREIGN PATENT DOCUMENTS

DE 3146725 A1 6/1983
DE 102011109801 B3 12/2012
(Continued)

OTHER PUBLICATIONS

PCT/EP2018/053066, International Search Report, European Patent Office, dated Apr. 19, 2018.
(Continued)

*Primary Examiner* — Eric W Golightly
(74) *Attorney, Agent, or Firm* — Ice Miller LLP.

(57) ABSTRACT

The invention proposes a cleaning device (110) for cleaning articles (116) to be cleaned. The cleaning device (110) comprises at least one cleaning chamber (114) and at least one application device (120) for applying at least one cleaning fluid to the articles (116) to be cleaned in the cleaning chamber (114). The cleaning device (110) further comprises at least one controller (157) which is designed to actuate the cleaning device (110) for carrying out at least two operating modes. The controller (157) is further designed to detect at least one utilization variable. The utilization variable characterizes a current utilization of the cleaning device (110). The controller (157) is further designed to assign at least one weighting to the at least one utilization variables. The controller (157) further has at least one counting device (170) which is designed to cumulate utilization times of the
(Continued)

cleaning device (110) which are weighted with the weighting and to generate at least one item of use information about a use of the cleaning device (110) therefrom.

25 Claims, 3 Drawing Sheets

(56) References Cited

FOREIGN PATENT DOCUMENTS

| | | | |
|---|---|---|---|
| EP | 2241240 | A1 | 10/2010 |
| WO | 2012046165 | A2 | 9/2011 |

OTHER PUBLICATIONS

PCT/EP2018/053066, Written Opinion of the International Searching Authority, European Patent Office, dated Apr. 19, 2018.
PCT/EP2018/053066, International Preliminary Report on Patentability, European Patent Office, dated Dec. 7, 2018.

CLEANING DEVICE AND METHOD FOR CLEANING ARTICLES TO BE CLEANED

CROSS-REFERENCE TO RELATED APPLICATIONS

The present application is a U.S. national stage patent application of, and claims the priority benefit of International Patent Application Serial No. PCT/EP2018/053066, filed Feb. 7, 2018, and also claims the priority benefit of German Patent Application Serial No. 10 2017 202055.5, filed Feb. 9, 2017, the text and drawings of which are hereby incorporated by reference in their entireties.

FIELD OF THE INVENTION

The invention relates to a method, a cleaning device and a cleaning system for cleaning articles to be cleaned, in particular for use in commercial dishwashing and/or in large-scale kitchens. Cleaning devices of said kind can be used, for example, in facilities for mass catering, such as, in particular, office canteens, canteens in schools, public authorities, hospitals or care facilities. The cleaning device can be used, in particular, for cleaning articles to be cleaned in the form of washware which is used directly or indirectly for preparing, storing or serving food and drinks. Said articles to be cleaned may be, in particular, dishes and/or trays. Other fields of use of the present invention are also feasible in principle, in particular fields of use with fundamentally any desired washware and/or in the domestic sector. Furthermore, use in cleaning care utensils, such as in cleaning and disinfection apparatuses, in particular so-called bedpan washers, for example, is also feasible. Use in cleaning apparatuses and/or disinfection apparatuses for personal protection equipment is also possible, for example for cleaning respiratory masks. Other fields of use are also possible in principle.

PRIOR ART

A large number of cleaning devices, also called cleaning apparatuses, which can clean and/or disinfect articles to be cleaned are known from the prior art. In the text which follows, without restricting other possible fields of use, the invention makes reference largely to the field of washing, in particular commercial washing, for example commercial dishwashing. Therefore, in addition to box-type washers with static washing processes, conveyor washers or pass-through dishwashers, in which the articles to be cleaned are transported through one or more cleaning chambers by means of a transportation device or can be inserted into a cleaning chamber, are known for example. The design of these cleaning devices depends overall to a great extent on the various boundary conditions, such as the type of articles to be cleaned, the soiling, the throughput or similar conditions for example. By way of example, reference can be made to cleaning devices which are described, for example, in DE 10 2004 056 052 A1, in DE 10 2007 025 263 A1 or in DE 10 2013 220 035 A1. Furthermore, in addition to cleaning devices for use in washing and in particular dishwashing, the invention can also be used for cleaning devices in other sectors in principle. For example, the invention can be used in cleaning devices which are designed as cleaning and disinfection apparatuses as are likewise described, for example, in DE 10 2004 056 052 A1, DE 10 2007 025 263 A1 or DE 10 2013 220 035 A1 which are designed, for example, for cleaning care utensils such as bedpans or urine bottles. On the other hand, as an alternative or in addition, the invention can also be used in cleaning devices which can be used for cleaning personal protection equipment, as described, for example, in WO 2011/144518 A2. However, other fields of use are also feasible.

In contrast to domestic dishwashing, commercial washers generally have a plurality of fluid tanks in order to be able to accelerate a throughput of articles to be cleaned. For example, in addition to the actual wash tank, a rinse tank is generally further provided, in which the temperature of rinse or final-rinse fluid can be adjusted as early as while the main washing process is still running Conveyor washers generally have a plurality of cleaning zones in which the articles to be cleaned are cleaned in sequence. However, this increase in the throughput is generally accompanied by a considerable increase in expenditure of energy and in many cases also an increase in a requirement for detergent solution in comparison to domestic dishwashing.

In particular, commercial dishwashers, but sometimes also dishwashers which can be used in the private sector or other cleaning devices, which are used in public authorities or clubs for example, in many cases represent a considerable investment. Relatively small businesses or else clubs and public authorities specifically are often not in a financial position to bear the investment costs associated with purchasing cleaning devices. Therefore, flexible utilization models which are not associated with complete purchase of the cleaning devices by the respective operators are becoming increasingly popular specifically in the cleaning sector. Rental models, hire purchase or other utilization models can be mentioned here merely by way of example.

However, one challenge in the case of a large number of alternative utilization models is the selection of suitable billing modalities which provide a balance between the interests of the operator and of the supplier of the cleaning device. In addition to billing based purely on a rental period, billing models which take into account actual utilization of the cleaning device are also known in principle. For example, DE 10 2011 109 801 B3 and EP 2 742 495 B1 describe a washer comprising a memory unit for storing an identification number (ID) and a key which allow unambiguous identification of the washer. The washer further comprises a data input unit for inputting a washing cycle receipt number (SBN), wherein a number of permitted washing cycles can be derived from the washing cycle receipt number (SBN). The washer also comprises an authorization unit which is designed to check whether the washing cycle receipt number (SBN) is valid for the washer identified by the identification number (ID) and the key and which is further designed to enable the washer for the number of washing cycles using the washing cycle receipt number (SBN) in the case of a positive identification or to block the washer in the case of a negative identification.

U.S. Pat. No. 4,076,554 A discloses a cost monitoring system for a dishwashing process. The pumps and/or valves through which the water flows during a dishwashing process are monitored. Monitoring devices provide output values on the basis of identical basic costs. These output values are combined and the costs of the dishwashing process are visually displayed.

US 2006/0 144 430 A1 discloses a method for providing information to a user of a car wash installation. The method comprises receiving one or more signals from a car wash installation, wherein the signal or the signals represent one or more payment processes. One or more signals which represent a value of one or more car wash functions which have been purchased with the one payment process or the plurality of payment processes are received from the car wash installation. The value of the one car wash function or the plurality of car wash functions which have been purchased with the one payment process or the plurality of payment processes is displayed. The method further comprises providing information which comprises displaying the value of the one car wash function or the plurality of car wash functions which have been purchased with the one payment process or the plurality of payment processes. Further configurations relate to a messaging device of an automatic vending machine and a car wash installation.

DE 199 05 979 A1 discloses a water-bearing domestic appliance, in particular a dishwasher or a washing machine. In order to provide simpler and more accurate control of the quantity of admixed untreated water in the water-bearing domestic appliance, in particular in a dishwasher or in a washing machine, having a water-softening device which consists substantially of an ion exchanger that can be regenerated and in which the water softened in the ion exchanger is blended by adding untreated water taking into account the degree of exhaustion of the ion exchanger, the water softened in the ion exchanger is filled into a storage container according to the invention. In this case, firstly the filling period for the storage container is detected and secondly this is summed to form a total filling period since the time at which the ion exchanger was last regenerated and, on the basis of the filling period, the quantity of soft water available for mixing is ascertained and, on the basis of the total filling period, the quantity of water softened by the ion exchanger since the time at which it was last regenerated and the corresponding state of exhaustion of the ion exchanger are ascertained and the quantity of untreated water to be added for the predetermined degree of hardness of the cleaning liquid is determined therefrom.

U.S. Pat. No. 5,371,681 A describes a vending device which can respond to a selection of various products for sale during the vending process by recalculating a time period which still remains for the vending process as a function of an allocation of an original fee paid and new calculation parameters which are associated with the newly selected product selection.

DE 31 46 725 A1 describes a high-pressure cleaning apparatus. The described high-pressure cleaning apparatus has the task of developing a high-pressure cleaning apparatus having a pay machine in such a way that the pay machine can be constructed in a substantially simpler and more cost-effective manner and that when a changeover is made from one mode of operation to another, the as yet unutilized working time for one mode of operation can be transferred to the other mode of operation. The invention is characterized in that the operating mode can be selected using a switch which is arranged on the operator control panel of the operator control part, in that a run time can be selected for each mode of operation by means of further operator control elements, and in that the sum of the selected run times is detected by a decoder and can be compared with the total time detected by the coin pulse counter. One configuration involves each mode of operation being assigned a relay coil and associated relay contacts for electromagnetically switching on the selected mode of operation, it being possible for the respective relay coil to be switched on by means of a switch, and each relay coil being connected in series with a time reference, wherein the outputs of the time references form the common input of the decoder.

CA 1 189 933 A describes a coin-operated car wash installation control arrangement which allows the user to use the car wash installation arrangement for different times and different functions. By virtue of providing two different time meters, two different functions can be requested and paid for and times can be accumulated. Furthermore, the user can make a changeover from one function to another function at any time and insert additional money as desired. A comparison device compares accrued time with used time and switches off the system when the two times correspond. The operator can preset two different time periods for the different functions.

DE 10 2004 056 052 A1 describes a method for assessing and ensuring the thermal hygiene effect on washware which is accommodated in a washing chamber of a single-chamber dishwasher, or articles to be cleaned which are accommodated in a cleaning chamber of an automatic cleaning and disinfection machine, wherein a temperature sensor is permanently assigned to the washing chamber or to the cleaning chamber. The thermal hygiene effect is detected using the temperature sensor and a controller by means of the temperature acting on the washware or the articles to be cleaned and an action time, and the thermal equivalent values are calculated therefrom.

In spite of the technical advantages associated with these configurations, a range of technical requirements still remain. In particular, the described washing cycle detection is comparatively less flexible and linked to prior enabling. Accordingly, for example, only prepaid models are possible with configurations of this kind. In addition, purely counting the washing cycles does not take into account, for example, the intensity of a utilization operation or the handling of the cleaning device by the user. In this case, the supplier of the cleaning device is faced with the disadvantage that rough handling of the cleaning device by the operator is not taken into account. For the operator himself, the described model has, for example, the disadvantage that careful utilization of the cleaning device is still not taken into account in the billing mode and is therefore not counted.

OBJECT OF THE INVENTION

The object of the present invention is therefore to provide a cleaning device, a cleaning system and a method for cleaning articles to be cleaned which at least largely avoid the disadvantages of known devices and methods of said type. In particular, the proposed devices and methods are intended to render possible more flexible billing models which are advantageous both for the supplier and also for the operator of the cleaning device.

DISCLOSURE OF THE INVENTION

This object is achieved by a cleaning device, a cleaning system and a method for cleaning articles to be cleaned having the features of the independent patent claims. Advantageous developments, which can be realized individually or in any desired combination, are presented in the dependent claims.

In the text which follows, the terms "have", "encompass", "comprise" or "include" or any grammatical departures therefrom are used non-exclusively. Accordingly, these terms can refer either to situations in which, besides the features introduced by these terms, no further features are present, or to situations in which one or more further features are present. For example, the expression "A has B", "A encompasses B", "A comprises B" or "A includes B" can refer either to the situation in which, apart from B, no further element is present in A (i.e. to a situation in which A exclusively consists of B), or to the situation in which, in addition to B, one or more further elements are present in A, for example element C, elements C and D or even further elements.

Furthermore, it should be noted that the terms "at least one" and "one or more" and grammatical modifications of these terms, if they are used in association with one or more elements or features and are intended to express the fact that the element or feature can be provided singularly or multiply, generally are used only once, for example when the feature or element is introduced for the first time. When the feature or element is subsequently mentioned again, the corresponding term "at least one" or "one or more" is generally no longer used, without restricting the possibility that the feature or element can be provided singularly or multiply.

Furthermore, in the text which follows, the terms "preferably", "in particular", "for example" or similar terms are used in conjunction with optional features, without alternative embodiments being restricted thereby. In this regard, features which are introduced by these terms are optional features, and the scope of protection of the claims, and in particular of the independent claims, is not intended to be restricted by these features. In this regard, the invention, as will be recognized by the person skilled in the art, can also be carried out using other configurations. In a similar way, features which are introduced by "in one embodiment of the invention" or by "in one exemplary embodiment of the invention" are understood as optional features, without alternative configurations or the scope of protection of the independent claims being intended to be restricted thereby. Furthermore, all possibilities of combining the features introduced by these introductory expressions with other features, be they optional or non-optional features, are intended to remain unaffected by these introductory expressions.

A first aspect of the present invention proposes a cleaning device for cleaning articles to be cleaned. The cleaning device comprises at least one cleaning chamber and at least one application device for applying at least one cleaning fluid to the articles to be cleaned in the cleaning chamber. The cleaning device further comprises at least one controller, wherein the controller is designed to actuate the cleaning device for carrying out at least two operating modes, in particular at least two cleaning programs. The controller is further designed to detect at least one utilization variable, wherein the utilization variable characterizes a current utilization of the cleaning device. The controller is further designed to assign at least one weighting to the at least one utilization variables. The controller further has at least one counting device which is designed to cumulate utilization times of the cleaning device which are weighted with the weighting and to generate at least one item of use information about a use of the cleaning device therefrom.

Within the scope of the present invention, a cleaning device is intended to be understood to mean, in general, a device which is designed to at least partially remove adhering impurities and/or germs from articles to be cleaned. The cleaning device can be, for example, a dishwasher, in particular a commercial dishwasher, for example a box-type dishwasher and/or a pass-through dishwasher. However, as an alternative or in addition, the cleaning device can also be entirely or partially configured as a cleaning and disinfection apparatus, for example as a cleaning device which is designed to clean containers for receiving human excreta. In general, reference can be made in this respect, for example, to the cleaning devices described in DE 10 2004 056 052 A1 and/or in DE 10 2007 025 263 A1. The cleaning device can also be a washer as can be used for cleaning containers in the field of food production and/or food processing. Furthermore, the cleaning device may be a disinfection washer, for example a washer for cleaning and disinfecting respiratory masks. However, other configurations are also conceivable in principle.

The cleaning device can be designed, in particular, as a conveyor washer, in particular as a pass-through dishwasher. Here, a conveyor dishwasher is intended to be understood to mean a dishwasher, that is to say a machine for cleaning washware in the form of dishes which is designed to transport the washware through a cleaning chamber. In particular, said conveyor dishwasher may be a flight-type dishwasher and/or a rack conveyor dishwasher, that is to say a dishwasher in which the crockery is transported through the cleaning device by means of a conveyor belt, for example a conveyor belt on which the crockery is placed directly and/or on which one or more racks carrying the crockery to be cleaned are placed. The conveyor dishwasher can be designed, in particular, for commercial use, for example in one or more of the abovementioned facilities for mass catering. However, other types of cleaning devices are also possible in principle.

The cleaning fluid can be, for example, a cleaning liquid and/or a gaseous cleaning fluid. For example, this cleaning fluid can comprise a cleaning liquid, for example an aqueous cleaning liquid, for example water in the form of fresh water and/or with one or more additives, for example with one or more detergent concentrates and/or one or more final rinse aid concentrates and/or one or more disinfectants. For example, the cleaning fluid can have one additive or a plurality of additives, for example at least one additive selected from the group consisting of a detergent concentrate, a final rinse aid and a disinfectant. As an alternative or in addition, the cleaning fluid can comprise, for example, steam. However, other configurations are also conceivable in principle. The at least one cleaning fluid can comprise, in principle, at least one cleaning liquid for example, in particular at least one aqueous cleaning liquid. Other types of cleaning fluids can also be used in principle. A cleaning fluid can therefore be understood to mean any desired fluid, in particular a liquid, which can have a cleaning effect on the articles to be cleaned.

Here, a cleaning chamber is understood to mean, in general, a chamber in which the above-described cleaning process for the articles to be cleaned is completely or partially carried out. In particular, the cleaning fluid or one of several cleaning fluids is/are applied in a cleaning chamber. Furthermore, the cleaning device can comprise at least one transportation device which is designed to transport the articles to be cleaned in a transportation direction from an inlet region, through the cleaning chamber, to an outlet region. The chamber is preferably completely or partially enclosed by a housing. In particular, the cleaning chamber can be of tunnel-like design or comprise a portion of a tunnel, for example with an inlet and an outlet, wherein the articles to be cleaned enter the cleaning chamber at the inlet and exit from the cleaning chamber at the outlet. An inlet is therefore intended to be understood to mean a region outside the cleaning chamber which is arranged directly in front of the cleaning chamber in the transportation direction and in which the articles to be cleaned can be placed on the transportation device. Accordingly, an outlet is intended to be understood to mean a region outside the cleaning chamber which is arranged directly behind the cleaning chamber in the transportation direction and in which the articles to be cleaned can be removed from the transportation device.

Within the scope of the present invention, a transportation device is intended to be understood to mean, in general, any desired device which is designed to transport the articles to be cleaned through the cleaning chamber in the transportation direction. For example, this transportation device can be selected from amongst a flight-type device with at least one conveyor belt, a latch transportation system and a roller transportation device having at least one transportation roller or a plurality of transportation rollers, for example one or more driven transportation rollers by means of which, for example, the articles to be cleaned can be transported directly and/or one or more racks which hold the articles to be cleaned can be transported through the cleaning chamber in the transportation direction. The transportation device can have, for example, at least one drive, for example at least one drive motor. For example, said drive can be a drive which drives at least one conveyor belt and/or at least one transportation roller or another type of transportation element of the transportation device.

Here, an application device is intended to be understood to mean, in principle, any desired device or combination of devices by means of which the cleaning fluid can be applied to the articles to be cleaned, for example by spraying, irradiating or dripping the cleaning fluid onto the articles to be cleaned. For example, the application device can have at least one nozzle system. Therefore, for example, one or more nozzle systems can be provided in the conveyor dishwasher. If a plurality of cleaning zones are provided for example, each cleaning zone can have, for example, at least one associated nozzle system of this kind. For example, the cleaning device can be designed in such a way that the articles to be cleaned pass the cleaning zones one after the other. For example, reference can be made to the above-mentioned prior art for an arrangement of cleaning zones of this kind.

The cleaning device comprises, as stated above, at least one controller. Within the scope of the present invention, a controller is intended to be understood to mean a one-part or multi-part device of the cleaning device which is designed to fully or partially control and/or regulate the operation of the cleaning device. In particular, the controller can be designed to modify, in particular to control and/or to regulate, one or more operating parameters of the cleaning device, for example at least one temperature, at least one pressure, at least one transportation speed or else a combination of said and/or other operating parameters. The controller can comprise, in particular, at least one data processing device, for example at least one processor. The controller can be designed in terms of programming in particular for example to control at least one cleaning program of the cleaning device and to control or to carry out a method according to the invention. Furthermore, the controller, as will be discussed in greater detail further below, can comprise at least one volatile and/or non-volatile data memory. The control unit can also comprise at least one interface, for example a man/machine interface for inputting commands and/or for outputting information, and/or a wireless or wired interface for unidirectional or bidirectional interchange of data and/or commands between the cleaning device and at least one further device. The controller can comprise, in particular, at least one computer and/or at least one processor. The controller can be, in particular, a centralized or decentralized machine controller of the cleaning device.

The controller is, as discussed above, designed to actuate the cleaning device to carry out at least two operating modes. Here, an operating mode is intended to be understood to mean an operation of the cleaning device which is characterized by at least one operating parameter. In general, an operation is intended to be understood to mean a utilization of the cleaning device. Therefore, the utilization can be configured either in such a way that the cleaning device is actually used to clean articles to be cleaned or that the cleaning device is operated in another manner in such a way that, for example, either it is ready to operate or, for example, a cleaning program or servicing program is carried out. An operating mode in which the cleaning device is used to clean articles to be cleaned can also be called a cleaning mode. Therefore, the at least two operating modes can comprise at least one cleaning mode or even at least two different cleaning modes. In general, the at least two operating modes can be selected, in particular, from the group consisting of: cleaning programs in which the cleaning fluid is applied to the articles to be cleaned; drying programs for drying the articles which have been cleaned; servicing programs for servicing the cleaning device; a standby mode; a self-cleaning mode of the cleaning device. However, other configurations are also possible.

In general, a cleaning program is intended to be understood to mean a continuous, a restricted-time or else a cyclical process in which the articles to be cleaned are cleaned under controlled conditions. Each cleaning program can be characterized, for example, by specific operating parameters which can be prespecified and preferably monitored, for example by the controller.

The controller is, as discussed above, designed to detect at least one utilization variable. Here, a utilization variables is intended to be understood to mean, in general, a measurable amount, a measurable variable or another detectable value which characterize a current utilization of the cleaning device. Said value may be, in general, a value which can be measured by means of at least one sensor or else a value which is actively prespecified by the controller, for example on the basis of a program sequence. In general, a utilization is intended to be understood to mean a manner of operation of the cleaning device which is determined by a program currently selected by the user, another prespecification by the user or by another manner of operation of the cleaning device. As will be discussed in greater detail below, the utilization can be characterized, in particular, by one or more operating parameters. In general, an operating parameter is intended to be understood to mean any desired measurable or detectable variable which characterizes an operation of the cleaning device or a portion of said operation. Therefore, whereas the at least one utilization variable describes, in general, how the cleaning device is utilized by a user, the at least one operating parameter describes the technical implementation of this utilization. Here, the utilization variable is intended to be understood as a general term since a utilization by a user in a specific manner naturally has an effect on the setting of one or more operating parameters. Accordingly, the at least one utilization variable can therefore comprise at least one operating parameter. However, as an alternative or in addition, the at least one utilization variable can also comprise other information, for example information which is derived from the at least one operating parameter, such as information about correct maintenance or servicing of the cleaning device and/or information about use of suitable media in the cleaning device for example. Furthermore, the at least one utilization variable can also comprise, for example, information about loading of the cleaning device with articles to be cleaned and/or about a throughput of articles to be cleaned through the cleaning device. Furthermore, the at least one utilization variable can also comprise at least one item of identification information which is unambiguously assigned to the cleaning device. For example, the controller can generate an item of information of this kind. For example, a unique machine identifier can be a constituent part of the at least one utilization variable.

Here, a "current" utilization is intended to be understood to mean, in general, the utilization characterized above at an observation time or over an observation time period. For example, the evaluation of the utilization and the weighting which will be described in greater detail below can be performed in real time. As an alternative, the evaluation of the utilization and the weighting which will be described in greater detail below can also be performed with a time offset, for example after a prespecified time period or following a cleaning program being carried out or else only upon request, for example by the user or an operator of the cleaning device.

The controller is, as discussed above, designed to assign at least one weighting to the at least one utilization variable. Here, a weighting is intended to be understood to mean, in general, an item of information about what contribution a specific utilization variable from amongst a plurality of possible utilization variables makes to the utilization information, which is actually generated at the end, for an observation time period. In particular, the weighting can be at least one weighting factor. For example, the weighting or, if a plurality of weightings are used, each of these weightings can be, for example, a real number, in particular a real number from 0 to 1. However, other values or value ranges are possible in principle. The technical background to this is, for example, that in particular specific types of utilization and therefore specific utilization variables make a greater contribution to wear of the cleaning device than other types of utilization. If, for example, it is known that specific parts which are subject to wear exist in a cleaning device, a utilization variable which characterizes a loading on a part which is subject to wear of this kind or a plurality of parts which are subject to wear of this kind are provided with a greater weighting than a utilization variable which has a lower effect on wear on the cleaning device.

The utilization variables can be simple or can also be comparatively complex and based on empirical values. For example, the cleaning device can be of simple configuration in order to carry out a gentle cleaning program at a relatively low temperature, for example of only 85° C., and a more intensive cleaning program at a relatively high temperature, for example 95° C. The type of cleaning program itself can be detected as a utilization variable, for example by way of the utilization variable p=1 being allocated to the gentler program and the utilization variable p=2 being allocated to the more intensive cleaning programs. The weighting for the utilization variable p=1 can be, for example, half the weighting for the utilization variable p=2, for example f(p=1)=0.5 and f(p=2)=1.0. For example, in the counting device which will be described in greater detail below, utilization times in which the cleaning device is operated with the gentle cleaning program can be provided with a weighting of 0.5, and utilization times in which the cleaning device is operated with the intensive cleaning program can be provided with a weighting of 1.0. As a result, a more realistic picture of wear on the cleaning device than, for example, with pure time detection can be produced over an observation time period. However, this simple example can be made more complex as desired since numerous cleaning programs can exist or numerous different operating modes which can each be characterized, for example, by specific operating parameters can exist. Here, in particular, operating parameters which are known to have a significant effect on utilization and/or wear on the cleaning device can be detected as utilization variables or in utilization variables and be weighted correspondingly.

The at least one weighting can be assigned to the at least one utilization variable in such a way that precisely one weighting is assigned to each detected utilization variables. However, other configurations are also possible in principle, for example by way of groups of utilization variables jointly receiving an assignment or by way of a plurality of weightings being assigned to one utilization variables. For example, a weighting function can be used as a function of several utilization variables, so that a weighting factor for weighting a unit of time is ascertained by this weighting function from a plurality of utilization variables for example. The assignment of the at least one weighting to the at least one utilization variable can be prespecified, for example fixedly prespecified, can be performed in real time or else can be performed with a time offset before or after consideration of the utilization.

The at least one weighting can be assigned to the at least one utilization variables automatically in particular, for example by a corresponding control program. In particular, the controller can contain at least one algorithm which assigns the at least one weighting to the at least one utilization variables, for example in the form of at least one function $f(p)$. A plurality of functions can also be provided, from amongst which, for example, in each case one function is selected, e.g. depending on at least one prespecified condition being fulfilled. As an alternative or in addition, the controller can contain at least one table, for example one electronic table and in particular at least one lookup table, which contains weightings for a plurality of utilization variables. This table can also be considered to be a function for example. In the abovementioned, simple example, the value of the weighting f=0.5 would be stored, for example, in the table for the value of the utilization variables p=1, and the weighting f=1.0 would be stored for the value of the utilization variables p=2. However, the tables can be designed with any desired complexity. Other types of assignment, for example as part of a fixedly prespecified computer program, are also possible and known to a person skilled in the art in principle.

As discussed above, the controller further has at least one counting device. As will be described in greater detail below, within the scope of the present invention, a "counting device" is intended to be understood to mean, in general, a device which is designed to generate an item of use information about a use of the cleaning device taking into account the current use of the cleaning device. The counting device can be entirely or partially configured in the hardware and/or entirely or partially configured as a software program. In particular, the counting device can be configured entirely or partially as a software module of control software. For example, the counting device can comprise a processor, for example a processor of the controller, which is designed in terms of programming to generate the user information. However, as an alternative or in addition, the counting device can also be configured entirely or partially as a separate software module or else entirely or partially as a separate hardware module. As discussed above, the controller can be of single-part design or multi-part design, so that the counting device can, for example, also be designed as a separate module which, however, can be connected to other constituent parts of the controller and which is theoretically considered to be a constituent part of the controller.

The counting device is designed to cumulate utilization times of the cleaning device which are weighted with the weighting and to generate at least one item of use information about a use of the cleaning device therefrom. Here, "utilization time" is intended to be understood to mean, in general, an infinitesimal or finite time period during which the cleaning device is operated, in particular in at least one operating mode. By way of example, said time period may be a time period during which the cleaning device or a portion thereof is supplied with electrical energy, is switched on or is in a standby mode. Here, the time period does not have to extend beyond the total duration of the operation in the operating mode, but rather can also be a portion thereof. In particular, the utilization time can comprise small time intervals which are each weighted and summed or integrated. Examples will be explained in greater detail below.

Here, "cumulation" is intended to be understood to mean, in general, summing or integration of values. In particular, said summing may be summing of time intervals which are each weighted with the at least one weighting. As an alternative or in addition, integration can also be performed, that is to say continuous summing of weighted time intervals, for example in the form of so-called weighted Riemann sums. In the abovementioned simple example of the gentle operating mode with the weighting f=0.5 and the more intensive operating mode with the weighting f=1.0, it is possible for a cumulation to lead to a result $S=c\cdot(0.5\cdot100+1.0\cdot500)=c\cdot550$, where c represents a calibration factor for example, in a case in which the cleaning device is operated for a total of 100 minutes in the gentle cleaning program and for 500 minutes in the intensive cleaning program for example. However, considerably more complex cumulations are also possible.

Within the scope of the present invention, "use information", also designated N below, is intended to be understood to mean, in general, an item of information about a use of the cleaning device, for example about an observation period or use period within which the above-described cumulation takes place. The use information can comprise, in particular, one or more items of information selected from the group consisting of: intensity of the utilization, wear, proper or improper utilization, type of utilization. The use information can be produced directly from the abovementioned cumulation of the weighted use times, so that, for example, the above-described value S=550 can directly represent the use information N(T). Given continuous or discontinuous further cumulation, the use information will change with time T, and therefore said use information is a function of time.

As an alternative or in addition, this cumulation can also be converted into the use information by an algorithm or, for example, by means of a table. For example, fictional "use units" can be defined which correlate, for example, linearly with the cumulation. However, as an alternative or in addition, one or more bonuses B or maluses M can be added or subtracted for example, so that, for example in the event of servicing or self-cleaning, a prespecified number b of use units is subtracted from the cumulation: N=S−B. In this way, servicing operations or self-cleaning operations of this kind can be acknowledged for example, for example by way of 5 use units being subtracted for each self-cleaning operation. Here, various models are feasible and can be implemented within the scope of the present invention.

The use information can be, in particular, directly or indirectly converted into a payment to a supplier of the cleaning device, for example in accordance with a particular tariff, in particular a tariff table. Examples will be mentioned in greater detail below. For example, the use information can be directly converted into a payment, can be converted at a flat rate, or a flat rate can be subtracted, can be subtracted from a credit, a credit can be credited to the use information or the like. However, in contrast to known billing methods, for example the intensity of utilization or else the regularity of use, for example the regular execution of self-cleaning programs for servicing, can now be included in the billing. As a result, the user himself is encouraged to handle the cleaning device with care since gentle and careful handling of this kind can have a positive effect on reduced payment. Furthermore, environmental aspects can also play a role here, so that for example environmentally friendly behavior has a positive effect for the user since, for example, environmentally friendly utilization can result in lower costs than environmentally harmful utilization. Various models are possible in principle.

The present invention is advantageous for the supplier of the machine in that in particular more realistic payments can be provided which take into account actual utilization and therefore also actual wear of the cleaning device. This plays a role particularly when cleaning devices are intended to be entrusted to a user only for a specific time and then used elsewhere. In conventional models, the user is billed either at a flat rate or simply after the rental period or else, as an alternative, for example after cycles, without the type and/or intensity of utilization being taken into account in the process.

The use information can also be used in other ways apart from for calculating a payment. For example, servicing intervals can also be matched to the actual utilization and therefore the provided use information and/or can be selected on the basis of the use information. For example, the use information can be compared with one or more threshold values in order to then output an item of information about required servicing and/or self-cleaning. For example, when 1000, 5000, 10,000 use units are reached, self-cleaning can be carried out automatically or a request for self-cleaning can be output in each case. Therefore, the self-cleaning and/or the servicing can be matched to the actual utilization, and this can have cost advantages and result in environmentally compatible behavior since, in the case of calculation of the intervals not taking into account the actual utilization, the worst-case use generally has to be used as the starting point.

The cleaning device according to the present invention can be advantageously developed in various ways. As discussed above, the cleaning device can be configured in various ways. In particular, the cleaning device can comprise a dishwasher, in particular a commercial dishwasher, with applications in a domestic sector also being possible however. The cleaning device can be selected, in particular, from the group consisting of: a single-chamber dishwasher; a pass-through dishwasher; a hood-type dishwasher; a conveyor dishwasher, in particular a flight-type or rack conveyor dishwasher; a cleaning and disinfection apparatus, in particular for cleaning and/or disinfecting care utensils; a cleaning device for cleaning and/or disinfecting personal protection equipment, in particular respiratory masks. Reference can be made, for example, to the abovementioned prior art in respect of possible configurations of these cleaning devices, apart from the special features according to the invention of the controller. The cleaning devices described there can be supplemented by the configuration of the controller described within the scope of the present invention. However, other configurations are also possible in principle.

In particular, the controller can be designed to detect the utilization times in accordance with a time detection mode, wherein the time detection mode is selected from the group consisting of: a continuous time detection operation; a cumulative time detection operation in discrete time intervals; a cumulative time detection operation in discrete utilization cycles. Within the scope of the present invention, the term "time" can therefore comprise, in general, a continuous time, for example a time in the form of an absolute time of day, a duration in seconds, minutes, hours or other units of time or the like. The time can be detected continuously or else in discrete intervals, for example by way of the smallest unit of time being 5 minutes or the like. Once again as an alternative or in addition, cycles can also be used as units of time and do not necessarily have to have the same duration. However, units of time of the same duration are preferably cumulated. However, other configurations are also possible in principle.

As discussed above, the weightings can be assigned fixedly or flexibly. In particular, the weighting can be assigned by means of at least one assignment algorithm and/or by means of an assignment table, as discussed by way of example above.

The utilization variable can comprise, in particular, at least one operating parameter of the cleaning device, which operating parameter is detected by the controller, or can be ascertained by means of at least one operating parameter of the cleaning device, which operating parameter is detected by the controller. Here, a large number of operating parameters can be used alternatively or cumulatively. In particular, the at least one operating parameter can be selected from the group consisting of: a temperature of the at least one cleaning fluid; a level of media consumption, in particular a level of consumption of at least one medium selected from the group consisting of: water or a detergent; a switch-on period of at least one consumer of the cleaning device, in particular of at least one heater and/or at least one pump, for example a circulation pump; a rotation speed of at least one nozzle arm of the application device; a property of at least one cleaning fluid, in particular a pH value and/or a hardness of at least one cleaning fluid, in particular a pH value and/or a hardness of water which is used in the cleaning fluid; a type of the at least one cleaning fluid and/or of a component of the at least one cleaning fluid; a heating power of at least one heating element of the cleaning device; an electrical energy intake of the cleaning device; a rotation speed of at least one pump; a number of pump revolutions; a pressure with which the articles to be cleaned are acted on; a volume flow which is sprayed by means of the application device; a door operation of at least one door of the cleaning device; a transportation parameter of at least one transportation device of the cleaning device, in particular a transportation speed; a transportation distance per unit of time; an absolute transportation distance; a quantity of articles to be cleaned; a quantity of transportation racks for articles to be cleaned; a throughput of articles to be cleaned; a type of a selected cleaning program; a quantity of cleaning fluid in at least one fluid tank of the cleaning device; a vibration of the cleaning device; an ambient temperature of the cleaning device; a type of at least one article to be cleaned which is cleaned in the cleaning device; a quantity of at least one article to be cleaned which is cleaned in the cleaning device; a material of at least one article to be cleaned which is cleaned in the cleaning device; a degree of soiling of at least one article to be cleaned which is cleaned in the cleaning device; a location of the cleaning device.

As discussed above, the at least one operating parameter can be detected or can be detectable or can also be prespecified or be prespecified. Therefore, said operating parameter can be, for example, at least one operating parameter which can be detected using sensors. However, as an alternative or in addition, said operating parameter can also be at least one operating parameter which is prespecified by the controller itself, for example within the scope of one or more washing programs, and is therefore known. Once again as an alternative or in addition, the at least one operating parameter can comprise, as discussed above, at least one operation of loading the cleaning device with articles to be cleaned, wherein at least one operating parameter selected from a type, a quantity, a material or a degree of soiling of the articles to be cleaned can be detected. This detection can once again be performed using sensors, for example by means of at least one image sensor and/or at least one material sensor, such as at least one metal sensor for example. However, as an alternative or in addition, the articles to be cleaned can also have at least one identifier which identifies, for example, the type and/or identity of the articles to be cleaned, such as at least one RFID chip and/or barcode for example, which can be detected by the cleaning device using sensors. Various configurations are feasible. Therefore, both actual values and also, for example, setpoint values can be used as operating parameters. In particular, the cleaning device can have at least one sensor, which is connected to the controller, for detecting the at least one operating parameter. It should be noted that any desired combinations are possible, for example including combinations comprising operating parameters which can be detected using sensors and prespecified operating parameters.

The at least one operating parameter may be, for example, an operating parameter which is actually present or which is prespecified by the controller, for example as a setpoint value. In particular, the at least one operating parameter can be prespecified by the user, either directly or in the form of a prespecification of a control program or cleaning program which implies the operating parameter. For example, the controller can have at least one user interface by means of which a user can prespecify the at least one operating parameter and/or change a value of the operating parameter, for example directly or else by selecting a corresponding cleaning program which implies, for example, a specific value or profile of the operating parameter. Therefore, the controller can be designed, for example, to allow the user to select at least one cleaning program by means of the user interface.

Further possible configurations relate to the possible calculation of the use information. As has been discussed by way of example above, there are numerous different options in this respect. In particular, the cumulation can be performed, as discussed above, continuously or else discontinuously. For example, the counting device can be designed to determine the use information in accordance with at least one algorithm selected from the group consisting of:

$$N(T)=c\cdot\int_T f(p_1, \ldots, p_n)dt \quad \text{i)}$$

$$N(T)=c\cdot\Sigma_i f(p_1, \ldots, p_n)\cdot\Delta t_i \quad \text{ii)}$$

$$N(T)=c\cdot\int_T f(p_1, \ldots, p_n)dt-B(T) \quad \text{iii)}$$

$$N(T)=c\cdot\Sigma_i f(p_1, \ldots, p_n)\cdot\Delta t_i-B(T) \quad \text{iv)}$$

where

N (T) is a current value of the use information at time T, c can be a calibration coefficient, for example a real number, T is an observation time at which the use information is intended to be determined, $p_1, \ldots, p_n$ are utilization variables, for example operating parameters, of the cleaning device, $f$ is a weighting function which is dependent on at least one operating parameter $p_i$, i is a running variable over all detected discrete use intervals, and B(T) is a bonus function which takes into account at least one performance of at least one maintenance process of the cleaning device.

As discussed above, other utilization variables can be used instead of the operating parameters or in addition to operating parameters. One or more operating parameters and/or utilization variables can be used, so that it is possible for n=1 or n>1.

Given a single utilization variable p, a simple function or table can be used as the weighting function in order to determine the weighting. If a plurality of utilization variables p are provided, more complex tables or else multidimensional functions can be used. A particularly simple option is that of forming at least one weighting function in the form of linear combinations of the utilization variables. Therefore, for example, the weighting function can be a linear combination of at least two utilization variables, for example operating parameters, which are weighted with weighting factors $b_j$:

$$f(p_1, \ldots, p_n) = \sum_{j=1}^{n} b_j \cdot p_j$$

As discussed above, the at least one utilization variable can characterize a utilization of the cleaning device in any desired manner. In particular, the at least one utilization variable or, if a plurality of utilization variables are provided, at least one of the utilization variables can also be designed to detect at least one service life and/or at least one standby time of the cleaning device. Therefore, these times, which for example also subject electronic components of the cleaning device to loading and wear in principle, can also be jointly detected and linked, for example, with a low weighting, for example a weighting of 0.2, in comparison to a weighting of 1.0 in the case of regular operation. In the simple, abovementioned example with the gentle cleaning program and the intensive cleaning program, for example a first utilization variable $p_1$ can therefore characterize whether the gentle cleaning program ($p_1$=1) or the intensive cleaning program ($p_1$=2) is running, and a second utilization variable $p_2$ can characterize whether the standby mode ($p_2$=1) or washing operation ($p_2$=2) prevails. Therefore, for example, the weighting function $f$ can be designed for time intervals dt or Δt as follows:

$$f(p_1=1, p_2=1)=0.5\cdot 0.2$$

$$f(p_1=2, p_2=1)=1.0\cdot 0.2$$

$$f(p_1=1, p_2=2)=0.5\cdot 1.0$$

$$f(p_1=2, p_2=2)=1.0\cdot 1.0$$

The time intervals are then weighted in a corresponding manner in the cumulation. Other, more complex options are also provided.

As discussed above, maintenance measures of the cleaning device can also be acknowledged by means of the present invention, in particular maintenance measures which are initiated by the user. Said maintenance measures may be, for example, a maintenance process in the form of a self-cleaning program and/or servicing or cleaning of the cleaning device. For example, the controller can be designed to detect performance of at least one maintenance process, wherein the counting device is designed to take into account the maintenance process when generating the use information. The controller can be designed, in particular, to take into account the maintenance process with an opposite mathematical sign in relation to a regular use in the use information. As described above, this can be, for example, in the form of a bonus which is subtracted from the cumulated value. The bonus can be, for example, fixedly prespecified or else can be determined in a variable manner, for example in accordance with the intensity and/or duration of the maintenance process. For example, a table for various maintenance processes and the corresponding bonuses can also be prespecified. The maintenance process can comprise, in particular, at least one element selected from the group consisting of: a self-cleaning cycle; a use of a maintenance medium, in particular a water softener and/or a descaler; a routine cleaning operation; a servicing operation of the cleaning device. However, other configurations are also possible in principle.

In a further aspect of the present invention, the cleaning device according to one or more of the above-described configurations and/or according to one or more of the configurations described in greater detail below can be used as a constituent part of a cleaning system. Here, a system is intended to be understood to mean, in general, a device which is made up of a plurality of interengaging components. The components can communicate with one another, for example, via one or more interfaces and in this way interact and cooperate. Accordingly, a cleaning system is intended to be understood to mean a system which is designed to carry out at least one cleaning process within the meaning of the above definition.

Therefore, the second aspect of the present invention proposes a cleaning system for cleaning articles to be cleaned, comprising at least one cleaning device according to the present invention and further comprising at least one reading apparatus, wherein the reading apparatus is designed to read out the use information from the cleaning device.

A reading apparatus is understood to mean, in general, a device which is designed to read out at least one item of information from another device and/or to receive information of this kind. The reading-out operation can be active or else passive, for example by way of the reading apparatus requesting the information or else by way of the information being transmitted to the reading apparatus without being requested. The reading apparatus can be designed, in particular, separately from the cleaning system and can be connected to the cleaning device via at least one interface. For example, the at least one interface can be selected from the group consisting of: a wireless interface, a wired interface, an electrical interface, an optical interface, an acoustic interface, an electromagnetic interface. Various configurations are feasible and known to a person skilled in the art in principle here.

The reading apparatus can be configured and/or used in various ways. Said reading apparatus may be a handheld apparatus for example. This handheld apparatus can be carried, for example, by a service engineer or else by a sales representative in order to read out the use information from a cleaning device on site. The service engineer can, as discussed above, use this information, for example, to identify whether servicing is required and possibly the form and/or intensity of servicing required. The sales representative can, for example, use the use information to calculate a utilization fee. Therefore, the reading apparatus can further have, for example, at least one cost calculation device which is designed to assign at least one utilization fee, also referred to as use fee, to the read-out use information. As discussed above, this can be done, for example, in the form of a tariff table or in another way. However, as an alternative or in addition to the configuration as a handheld apparatus, the reading apparatus can also be entirely or partially configured in another way, for example as a computer, for example a computer which is incorporated into a network and is connected to the cleaning device via the network and can read out the use information. Once again as an alternative or in addition, the reading apparatus can also be configured as a mobile communication apparatus, for example as a smartphone.

A further aspect of the present invention proposes a method for operating a cleaning device. Here, the cleaning device can be configured, in particular, according to the present invention, and therefore reference can be made, for example, to the above description of the cleaning device according to the invention and the possible configuration options therein or else to the following description of possible exemplary embodiments, and vice versa. However, other configurations are also possible in principle. The method comprises the method steps described in greater detail below. These method steps can be carried out, in particular, in the stated order. However, another order is also possible in principle. Furthermore, one, several or all of the method steps can be carried out singly or individually or in groups in a repeated fashion. Furthermore, two or more method steps can also be carried out with an overlap or in parallel with respect to time. Furthermore, one, several or all of the method steps can also be carried out continuously.

In general, the method serves for operating a cleaning device for cleaning articles to be cleaned, wherein the cleaning device has at least one cleaning chamber and at least one application device for applying at least one cleaning fluid to the articles to be cleaned in the cleaning chamber. The method comprises the following steps:

a) detecting at least one utilization variables of the cleaning device, wherein the utilization variable characterizes the current utilization of the cleaning device;
b) assigning at least one weighting to the at least one utilization variables;
c) generating at least one item of use information about a use of the cleaning device from a cumulation of the utilization times of the cleaning device which are weighted with the weighting.

As discussed above, a cleaning device according to the invention can be used in particular. Accordingly, reference can be made to the above description in respect of possible configurations and definitions.

In particular, method steps a) and b) can be carried out in a repeated fashion. Therefore, in particular, method steps a) and b) can be carried out continuously, at regular intervals or at prespecified times. However, other configurations are also possible in principle.

The proposed method can be implemented particularly easily by means of at least one computer. This computer can be contained, in particular, in at least one controller of the cleaning device since said controller can contain, as discussed above, in particular at least one data processing device, in particular at least one computer. In particular, the method steps a) to c) can be carried out using at least one computer or computer program.

Accordingly, the invention further proposes a computer-readable data structure which is designed to carry out the method according to the invention in one of the described configurations if the data structure is executed by a computer or computer network, in particular a computer or computer network of the controller of the cleaning device. The computer-readable data structure can be stored, in particular, on at least one data carrier. The invention further proposes a computer program comprising program code for carrying out the method according to the invention in one of the described configurations, wherein said method is carried out if the computer program is executed on a computer or computer network, for example on a controller of the cleaning device. The invention further proposes a computer program product comprising program code means, wherein the program code means are stored or can be stored on a storage medium, wherein the program code means are designed to carry out the method as claimed in one of the preceding method claims if the program code means are executed on a computer or computer network, in particular on a controller of the cleaning device.

A further aspect proposes the use of the cleaning device according to the invention in one or more of the above-described configurations or in one or more of the configurations described in greater detail below for use-dependent calculation of a utilization fee for the cleaning device.

In summary, the following embodiments are particularly preferred within the scope of the present invention:

Embodiment 1: a cleaning device for cleaning articles to be cleaned, comprising at least one cleaning chamber and at least one application device for applying at least one cleaning fluid to the articles to be cleaned in the cleaning chamber, further comprising at least one controller, wherein the controller is designed to actuate the cleaning device for carrying out at least two operating modes, wherein the controller is further designed to detect at least one utilization variable, wherein the utilization variable characterizes a current utilization of the cleaning device, wherein the controller is further designed to assign at least one weighting to the at least one utilization variables, wherein the controller further has at least one counting device, wherein the counting device is designed to cumulate utilization times of the cleaning device which are weighted with the weighting and to generate at least one item of use information about a use of the cleaning device therefrom.

Embodiment 2: the cleaning device according to the preceding embodiment, wherein the cleaning device is selected from the group consisting of: a single-chamber dishwasher, in particular a commercial single-chamber dishwasher; a pass-through dishwasher; a hood-type dishwasher; a conveyor dishwasher, in particular a flight-type or rack conveyor dishwasher; a cleaning and disinfection apparatus, in particular for cleaning and/or disinfecting care utensils; a cleaning device for cleaning and/or disinfecting personal protection equipment, in particular respiratory masks.

Embodiment 3: the cleaning device according to either of the preceding embodiments, wherein the controller is designed to detect the utilization times in accordance with a time detection mode, wherein the time detection mode is selected from the group consisting of: a continuous time detection operation; a cumulative time detection operation in discrete time intervals; a cumulative time detection operation in discrete utilization cycles.

Embodiment 4: the cleaning device according to one of the preceding embodiments, wherein the controller is designed to carry out the assignment of the weighting by means of at least one assignment algorithm and/or by means of at least one assignment table.

Embodiment 5: the cleaning device according to one of the preceding embodiments, wherein the utilization variable comprises at least one operating parameter of the cleaning device, which operating parameter is detected by the controller, or is ascertained by means of at least one operating parameter of the cleaning device, which operating parameter is detected by the controller.

Embodiment 6: the cleaning device according to the preceding embodiment, wherein the at least one operating parameter is selected from the group consisting of: a temperature of the at least one cleaning fluid; a level of media consumption, in particular a level of consumption of at least one medium selected from the group consisting of: water or a detergent; a switch-on period of at least one consumer of the cleaning device, in particular at least one heater and/or at least one pump, for example a circulation pump; a rotation speed of at least one nozzle arm of the application device; a property of at least one cleaning fluid, in particular a pH value and/or a hardness of at least one cleaning fluid, in particular a pH value and/or a hardness of water which is used in the cleaning fluid; a type of the at least one cleaning fluid and/or of a component of the at least one cleaning fluid; a heating power of at least one heating element of the cleaning device; an electrical energy intake of the cleaning device; a rotation speed of at least one pump; a number of pump revolutions; a pressure with which the articles to be cleaned are acted on; a volume flow which is sprayed by means of the application device; a door operation of at least one door of the cleaning device; a transportation parameter of at least one transportation device of the cleaning device, in particular a transportation speed; a transportation distance per unit of time; an absolute transportation distance; a quantity of articles to be cleaned; a quantity of transportation racks for articles to be cleaned; a throughput of articles to be cleaned; a type of a selected cleaning program; a quantity of cleaning fluid in at least one fluid tank of the cleaning device; a vibration of the cleaning device; an ambient temperature of the cleaning device; a type of at least one article to be cleaned which is cleaned in the cleaning device; a quantity of at least one article to be cleaned which is cleaned in the cleaning device; a material of at least one article to be cleaned which is cleaned in the cleaning device; a degree of soiling of at least one article to be cleaned which is cleaned in the cleaning device; a location of the cleaning device.

Embodiment 7: the cleaning device according to one of the two preceding embodiments, wherein the cleaning device has at least one sensor, which is connected to the controller, for detecting the at least one operating parameter.

Embodiment 8: the cleaning device as claimed in one of the three preceding embodiments, wherein the controller has at least one user interface by means of which a user can change the at least one operating parameter.

Embodiment 9: the cleaning device according to the preceding embodiment, wherein the controller is designed to allow the user to select at least one cleaning program by means of the user interface.

Embodiment 10: the cleaning device according to one of the preceding embodiments, wherein the counting device is designed to determine the use information in accordance with at least one algorithm selected from the group consisting of:

$$N(T)=c\cdot\int_T f(p_1, \ldots, p_n)dt \quad \text{i)}$$

$$N(T)=c\cdot\Sigma_i f(p_1, \ldots, p_n)\cdot\Delta t_i \quad \text{ii)}$$

$$N(T)=c\cdot\int_T f(p_1, \ldots, p_n)dt-B(T) \quad \text{iii)}$$

$$N(T)=c\cdot\Sigma_i f(p_1, \ldots, p_n)\cdot\Delta t_i-B(T) \quad \text{iv)}$$

where

N (T) is a current value of the use information at time T, c is a calibration coefficient, T is an observation time at which the use information is intended to be determined, $p_1, \ldots, p_n$ are utilization variables of the cleaning device, f is a weighting function which is dependent on at least one utilization variable $p_i$, i is a running variable over all detected discrete use intervals, and B(T) is a bonus function which takes into account at least one performance of at least one maintenance process of the cleaning device.

Embodiment 11: the cleaning device according to the preceding embodiment, wherein the weighting function is a linear combination of at least two utilization variables which are weighted with weighting factors $b_j$:

$$f(p_1, \ldots, p_n) = \sum_{j=1}^{n} b_j \cdot p_j$$

Embodiment 12: the cleaning device according to one of the preceding embodiments, wherein the controller is further designed in such a way that the at least one utilization variable comprises at least one service life and/or at least one standby time of the cleaning device.

Embodiment 13: the cleaning device according to one of the preceding embodiments, wherein the controller is further designed to detect performance of at least one maintenance process, wherein the counting device is designed to take into account the maintenance process when generating the use information.

Embodiment 14: the cleaning device according to the preceding embodiment, wherein the controller is designed to take into account the maintenance process with an opposite mathematical sign in relation to a regular use in the use information.

Embodiment 15: the cleaning device according to one of the two preceding embodiments, wherein the maintenance process comprises at least one element selected from the group consisting of: a self-cleaning cycle; a use of a maintenance medium, in particular a water softener and/or a descaler; a routine cleaning operation; a servicing operation of the cleaning device.

Embodiment 16: a cleaning system for cleaning articles to be cleaned, comprising at least one cleaning device according to one of the preceding embodiments, further comprising at least one reading apparatus, wherein the reading apparatus is designed to read out the use information from the cleaning device.

Embodiment 17: the cleaning system according to the preceding embodiment, wherein the reading apparatus is designed separately from the cleaning system and can be connected to the cleaning device via at least one interface.

Embodiment 18: the cleaning system according to either of the two preceding embodiments, wherein the reading apparatus further has at least one cost calculation device, wherein the cost calculation device is designed to assign at least one use fee to the read-out use information.

Embodiment 19: method for operating a cleaning device for cleaning articles to be cleaned, wherein the cleaning device has at least one cleaning chamber and at least one application device for applying at least one cleaning fluid to the articles to be cleaned in the cleaning chamber, wherein the method comprises the following steps:

a) detecting at least one utilization variables of the cleaning device, wherein the utilization variable characterizes the current utilization of the cleaning device;
b) assigning at least one weighting to the at least one utilization variables;
c) generating at least one item of use information about a use of the cleaning device from a cumulation of the utilization times of the cleaning device which are weighted with the weighting.

Embodiment 20: the method according to the preceding embodiment, wherein a cleaning device according to one of the preceding embodiments, which relate to a cleaning device, is used.

Embodiment 21: the method according to either of the preceding embodiments, which relate to a method, wherein the method steps a) and b) are carried out in a repeated fashion.

Embodiment 22: the method according to the preceding embodiment, wherein the method steps a) and b) are carried out continuously, at regular intervals or at prespecified times.

Embodiment 23: the method according to one of the preceding embodiments, which relate to a method, wherein the method steps a) to c) are carried out using at least one computer or computer program.

Embodiment 24: a computer-readable data structure which is designed to carry out the method according to one of the preceding embodiments, which relates to a method, if the data structure is executed by a computer or computer network.

Embodiment 25: the computer-readable data structure according to the preceding embodiment, wherein the data structure is stored on at least one data carrier.

Embodiment 26: a computer program comprising program code for carrying out the method according to one of the preceding embodiments, which relates to a method, if the computer program is executed on a computer or computer network.

Embodiment 27: a computer program product comprising program code means, wherein the program code means are stored or can be stored on a storage medium, wherein the program code means are designed to carry out the method according to one of the preceding embodiments, which relates to a method, if the program code means are executed on a computer or computer network.

Embodiment 28: the use of a cleaning device according to one of the preceding embodiments, which relates to a cleaning device, for use-dependent calculation of a utilization fee for the cleaning device.

BRIEF DESCRIPTION OF THE FIGURES

Further details and features of the invention can be found in the description of preferred exemplary embodiments which follows, in particular in conjunction with the dependent claims. In this context, the particular features may be implemented alone or severally in combination with one another. The invention is not restricted to the exemplary embodiments. The exemplary embodiments are shown schematically in the figures. Identical reference numerals in the individual figures refer to identical elements or elements with an identical function, or elements which correspond to one another in respect of their function.

Specifically.

DESCRIPTION OF THE EXEMPLARY EMBODIMENTS

Figure 1:
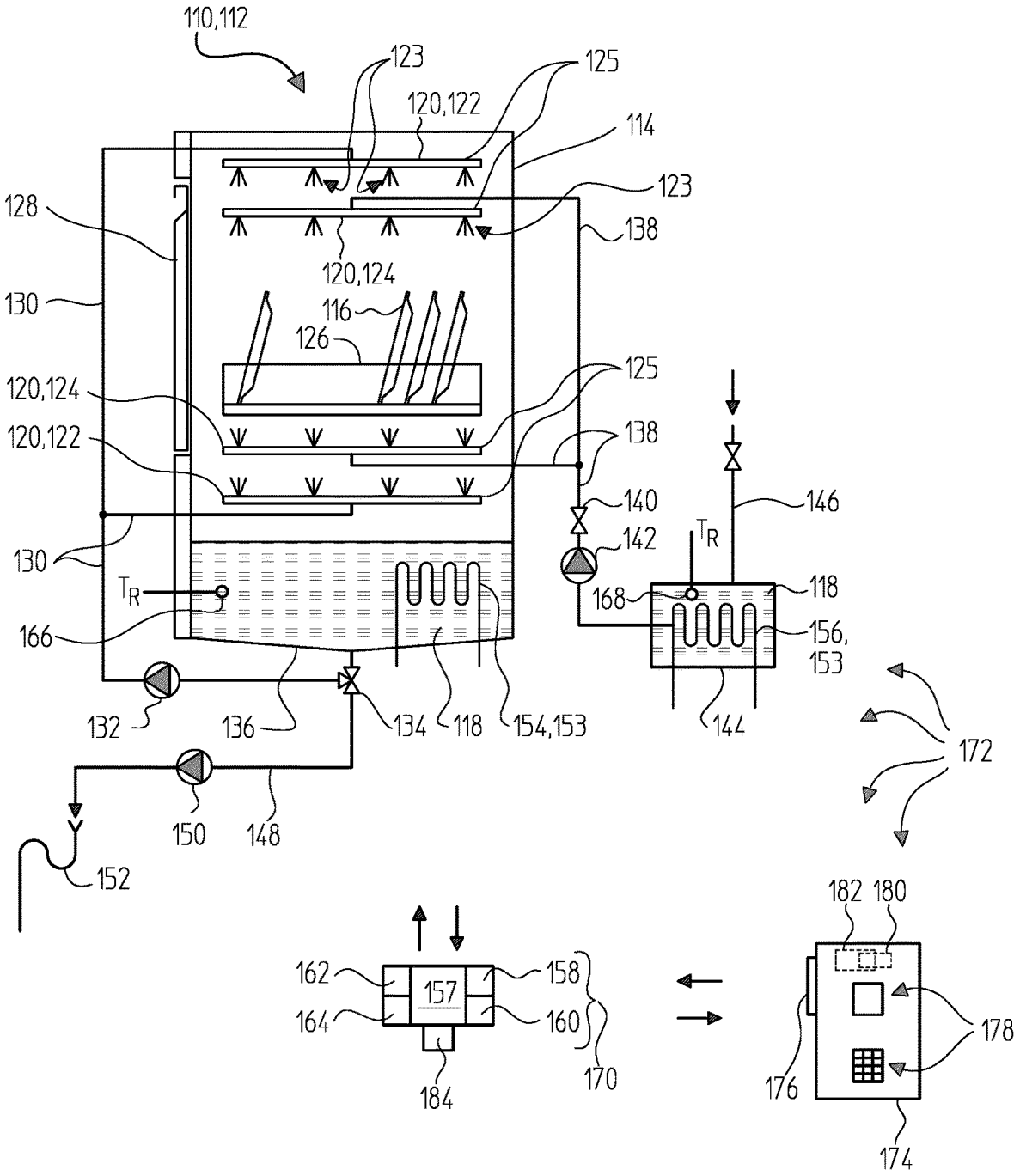
FIG. 1 shows an exemplary embodiment of a cleaning device in the form of a single-chamber dishwasher and also an exemplary embodiment of a cleaning system.
Figure 3:
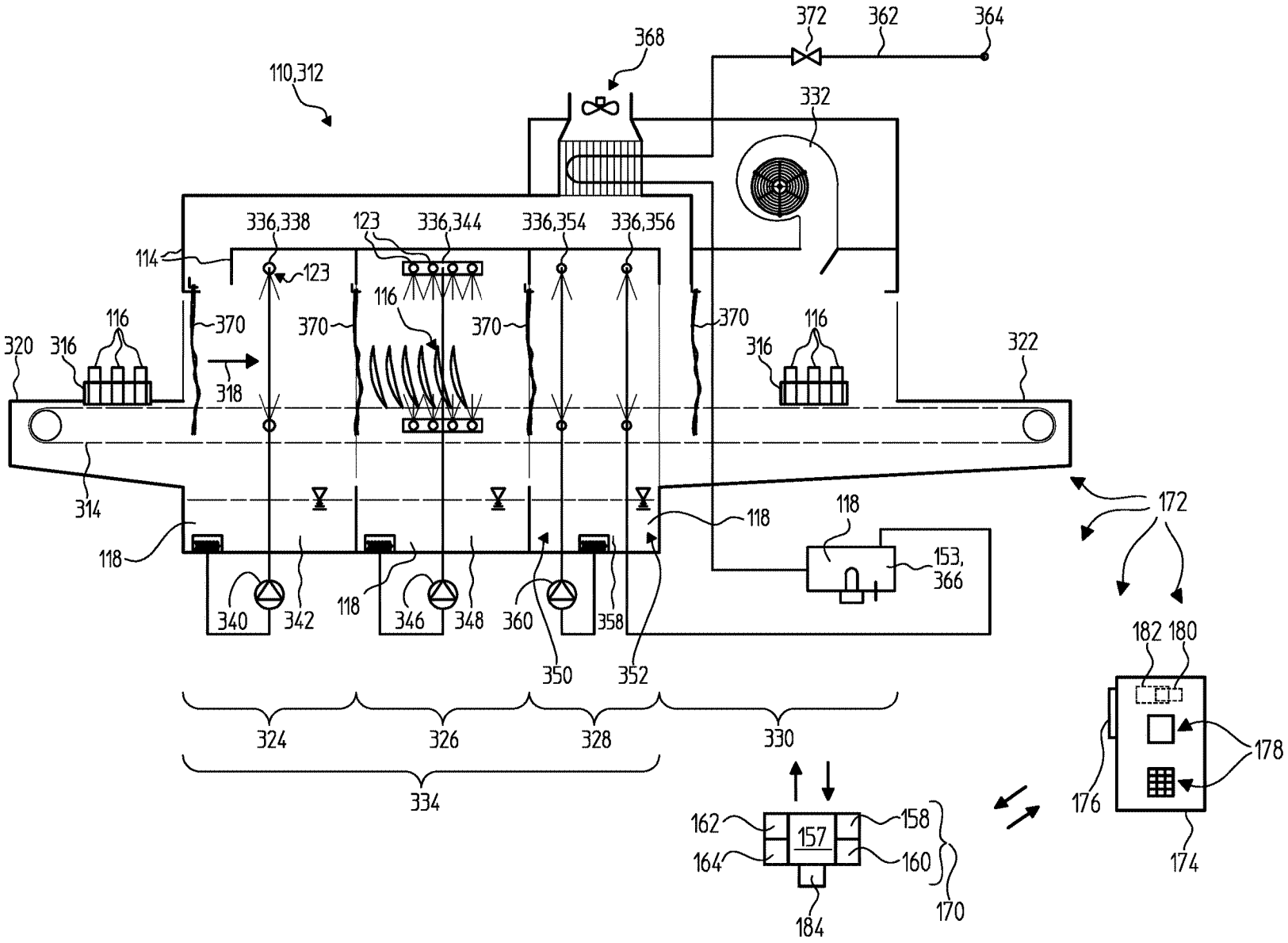
FIG. 3 shows an exemplary embodiment of a cleaning device in the form of a pass-through dishwasher and also a further exemplary embodiment of a cleaning system.

FIGS. 1 and 3 illustrate exemplary embodiments of cleaning devices 110 according to the invention. In the exemplary embodiment according to FIG. 1, said cleaning device is a single-chamber dishwasher 112, whereas a pass-through dishwasher 312, also referred to as a conveyor dishwasher, is illustrated in the exemplary embodiment according to FIG. 3. It should be noted that these are merely examples of possible cleaning devices 110. As an alternative or in addition, other cleaning devices also come into consideration, for example cleaning and disinfection apparatuses or cleaning devices for types of washware other than dishes.

The cleaning device 110 in FIG. 1 can be configured, in particular, as a commercial single-chamber dishwasher. However, a configuration as a domestic dishwasher is also possible in principle. Reference can be made, by way of example, to DE 10 2008 015 796 B4 for examples of possible configurations of single-chamber dishwashers 112 of this kind. However, other configurations are also possible.

The cleaning device 110 has at least one cleaning chamber 114. Cleaning fluid 118 is applied to articles 116 to be cleaned, in particular dishes, in the cleaning chamber 114. One or more application devices 120, which can also be referred to as fluid devices in this exemplary embodiment, are provided for this application operation. These application devices 120 can comprise, by way of example, a washing nozzle system 122 and a rinse nozzle system 124. The application device 120 comprises, for example, a plurality of nozzles 123 which can be arranged, for example, in spray arms 125 of the application device 120, for example in rotating spray arms 125. The nozzle systems 122, 124 can be arranged, for example, within the cleaning chamber 114 above and/or below a rack 126 in which the articles 116 to be cleaned are accommodated. The cleaning chamber 114 can be loaded with the articles 116 to be cleaned, for example, via a door 128, for example a front hatch.

The nozzle system 122 can be fed, for example via washing lines 130, a washing pump 132 and via a 3-way valve 134, with cleaning fluid 118, for example a detergent solution, from a washing tank 136 which can be located, for example, in the bottom region of the cleaning chamber 114. Cleaning fluid 118 from a rinse tank 144, for example rinse fluid in the form of final rinse aid solution, can be applied to the optional rinse nozzle system 124, for example, via rinse lines 138, a rinse valve 140 and a rinse pump 142. The rinse tank 144 can be fed, for example, with fresh water via a fresh water supply line 146. Furthermore, the cleaning device 110 can have a discharge line 148 which can be connected, for example, to the washing tank 136 via the 3-way valve 134 and can optionally have a discharge pump 150 and can optionally be connected to an outlet 152.

The cleaning device 110 can further have at least one temperature control device 153 for controlling the temperature of the at least one cleaning fluid 118. Furthermore, the heating device 110 can have a further heating element 156 in the rinse tank 144 for heating the cleaning fluid 118 in the form of the rinse fluid which is accommodated there. For example, the rinse tank 144 can be configured as a boiler and/or can have a flow heater.

At least one cleaning program, for example, can be executed in the cleaning device 110 which can be configured, for example, as a box-type dishwasher. To this end, at least one controller 157, by means of which a program sequence can be controlled, can be provided for example. In said cleaning program, a first program step can be carried out for example, the articles 116 to be cleaned being washed with liquid from the wash tank 136 in said first program step. This washing can be performed, for example, in a circulation mode via the washing pump 132 which can also be referred to as a circulation pump. The washing liquid can then be partially or completely drained from the washing tank 136 via the discharge pump 150 and the 3-way valve 134. In parallel with the washing step, rinse fluid can be prepared, for example heated, in the rinse tank 144 in advance. In a further program step which follows the washing step, the articles 116 to be cleaned can then be subjected to rinsing or final rinsing with cleaning fluid from the rinse tank 144, it being possible for this to be performed in a single operation or, optionally, likewise in a circulation mode. One or more further program steps can follow, for example one or more drying steps, before the cleaning program can be terminated.

The controller 157 can comprise, for example, at least one processor 158 and at least one data memory 160. The controller 157 can further have at least one user interface 162 and/or at least one data interface 164, for example for wireless or wired interchange of data and/or control commands. The controller 157 is designed, in particular, to actuate the cleaning device 110 in at least two operating modes. Said operating modes may be, for example, two or more cleaning programs. Said cleaning programs can be selected by a user, for example, via the user interface 162. However, as an alternative or in addition, the user can also select further details, such as directly adjust specific operating parameters for example, via the user interface 162.

The cleaning device 110 further has, for example, a plurality of sensors for detecting operating parameters. For example, these sensors can comprise a temperature sensor 166 in the washing tank 136 and also a temperature sensor 168 in the rinse tank 144. Furthermore, the controller 157 can also be designed to detect operating parameters, for example pump rotation speeds of the pumps 132, 142 and 150, pump rotation speeds of the pumps 132, 142 and 150, valve positions of the valves 134, 140 and also heating powers of the heating elements 154, 156, in another way. As an alternative or in addition, other operating parameters can also be detected, for example by means of pressure sensors, volume flow sensors or similar sensors or items of control information.

Figure 2:
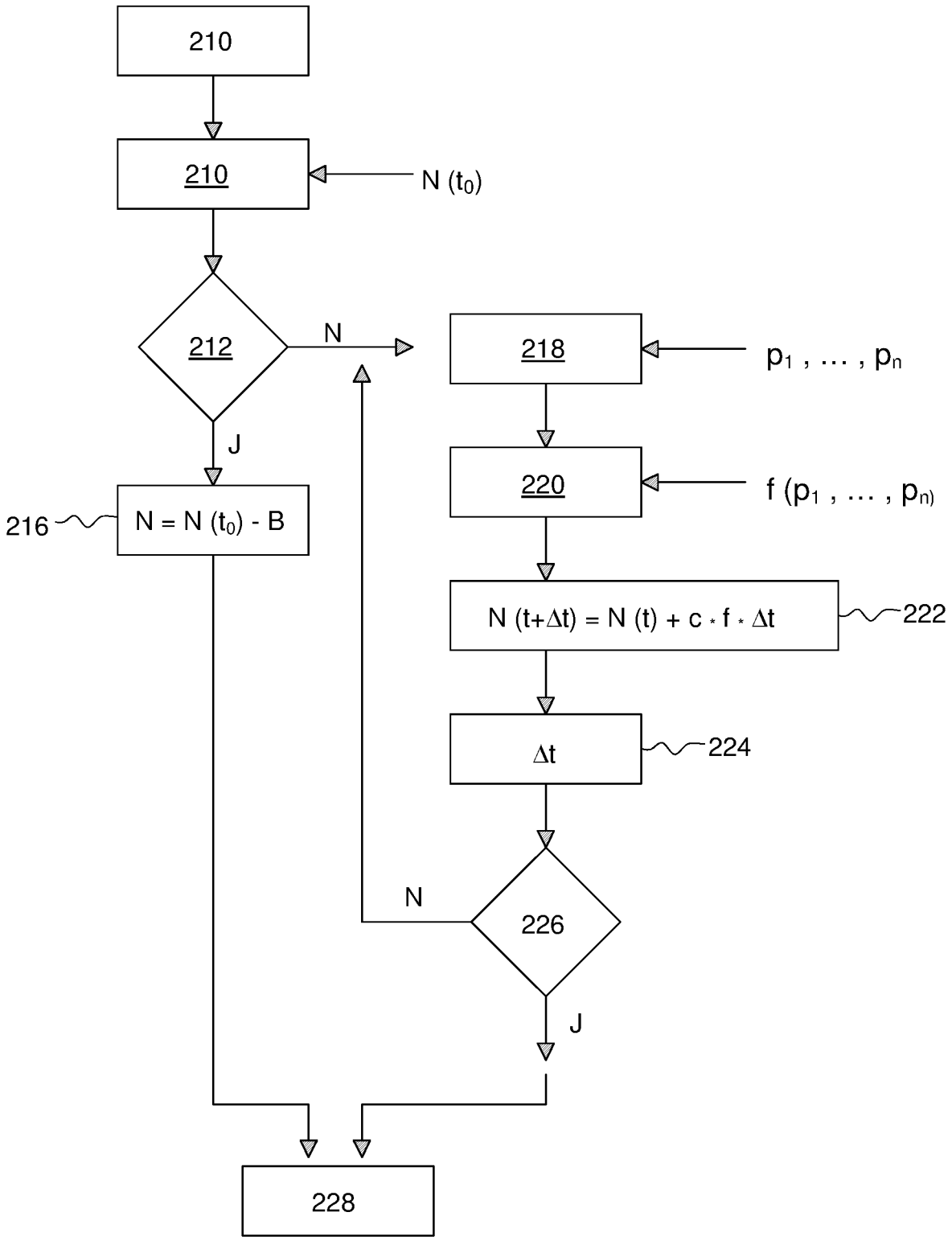
FIG. 2 shows a flowchart of an exemplary embodiment of a method for operating the cleaning device.

The controller 157 is accordingly designed to detect at least one utilization variable, wherein the at least one utilization variable can comprise, for example, at least one operating parameter. However, as an alternative or in addition, the at least one utilization variable can also comprise other types of information, for example which washing program the user has selected. The at least one utilization variable characterizes a current utilization of the cleaning device 110. The controller 157 is designed to assign at least one weighting to the at least one utilization variables. The controller 157 further has a counting device 170 which, in this case, can comprise the processor 158 and the data memory 160 for example. The counting device is designed, for example in terms of programming, to cumulate utilization times of the cleaning device 110 which are weighted with the weighting and to generate at least one item of use information about a use of the cleaning device therefrom. This will be explained by way of example with reference to a flowchart of a possible method for operating the cleaning device 110 in FIG. 2.

In the method, after the start 210, a value for a current, already cumulated utilization variable $N(t_0)$ is read out from the data memory 160. The start time of this method t is therefore set to $t=t_0$, and the utilization variable at the beginning of this run of the method is set to $N(t)=N(t_0)$. This method step 212 serves to allow values cumulated in a previous performance of the method to be re-used, so that a value for the utilization variable N, which value is cumulated over a plurality of method sequences overall, can be generated. However, servicing personnel can, for example, also reset the value N in the data memory 160 or adjust said value to a prespecified start value.

In step 212, a query is then made as to whether a maintenance process is currently being carried out. This query can be answered, for example, by way of a corresponding item of information of the controller 157, for example by way of whether a user has set a maintenance program or another cleaning program. If the maintenance program is being carried out (method step 216), a bonus B is subtracted from the current value $N(t_0)$ and, in method step 228, the current value $N=N(t_0)-B$ is written to the data memory 160. The program is then terminated. If, in contrast, a maintenance program is not being carried out, detection of the one or more utilization variables is then carried out in method step 218. By way of example, said utilization variables are designated $p_1, \ldots, p_n$. A weighting is then assigned to these utilization variables in method step 220. This is shown by way of example with reference to table 1.

TABLE 1

Example of an assignment of a weighting to the utilization variable in the form of two heating powers in fluid tanks

| | $p_2$ = 3.0 kW | $p_2$ = 6.0 kW |
|---|---|---|
| $p_1$ = 2.0 kW | f = 0.5/min | f = 0.8/min |
| $p_1$ = 2.5 kW | f = 0.6/min | f = 0.9/min |
| $p_1$ = 3.0 kW | f = 0.8/min | f = 1.1/min |

This table 1 contains, by way of example, two operating parameters which are used as utilization variables, specifically a heating power $p_1$ of the heating element 154 in the washing tank 136 and a heating power $p_2$ of the further heating element 156 in the rinse tank 144. However, it should be noted that significantly more complex assignments are possible by means of multidimensional tables. In this exemplary embodiment, the heating power can be set, by programming, for example for the heating element 154 to the values 2.0 kW, 2.5 kW and 3.0 kW, and the heating power $p_2$ can be set to the values 3.0 kW and 6.0 kW. The values for the weighting f which are assigned to each of these possible combinations are indicated in the table. As can be seen here, the weighting can be provided with a dimension or, in principle, can also be dimensionless, depending on the ultimately desired value for the utilization variable. In this case, the weighting is indicated, for example, with the unit/min since multiplication by units of time, indicated in min, is then performed, as will be discussed in greater detail below.

The assignment according to table 1 is only one of several possible assignments which represent an actual utilization, for example an actual loading, of the cleaning device 110. If, for example, in addition to said operating parameters $p_1$, $p_2$ in the form of said heating powers, a pump rotation speed for example of the rinse pump 142 in revolutions/min is detected as utilization variable $p_3$ and a temperature in ° C. which is detected by means of the temperature sensor 168 in the rinse tank 144 is detected as utilization variable $p_4$, an assignment could also be performed, for example, by means of an assignment algorithm, for example of the following type:

$$f(p_1, p_2, p_3, p_4) = \frac{0.5 \cdot p_1}{10\ \text{kW} \cdot \text{min}} + \frac{0.8 \cdot p_2}{10\ \text{kW} \cdot \text{min}} + \frac{0.3 \cdot p_3}{10{,}000} + \frac{0.1 \cdot p_4}{85°\ \text{C.} \cdot \text{min}}$$

As can be seen, the ascertained weighting ultimately has the unit of time/min in this case too.

Following method step 220 which can be carried out by the counting device 170, in method step 222 the utilization variables N are incremented for the time period between $t_0$ and $t_0+\Delta t$, for example in accordance with the formula $$N(t+\Delta t)=N(t)+c \cdot f \cdot \Delta t$$

Here, c designates a calibration factor which can optionally also be incorporated in addition. This new value of N can be stored, for example, in the data memory 160, for example likewise still in step 222, so that the next program run and also the next program loop can, for example, already be carried out with this incremented value. Then, there is a waiting time period Δt in step 224. The time period Δt can be fixed or else can be flexible, for example depending on the program sequence. For example, the time period Δt can be a time period of 0.5 min or else 1 min Other values are also feasible.

Then, in step 226, a query is made as to whether the program has been terminated. If this is the case, the current value for the use information N is written to the data memory 160 in step 228 again. If this is not the case, the program can return, for example with the current value N(t) as the start value, to step 218 and detect the utilization variables once again. In this way, a cumulated use, which takes into account actual loadings of the cleaning device 110, is detected by means of this simple program over the operation of the cleaning device. It should be noted that the illustrated sequence merely represents an example of a sequence which can be significantly more complex in practice.

At the same time, FIG. 1 also illustrates an exemplary embodiment of a cleaning system 172. This cleaning system 172 further comprises, in addition to the cleaning device 110, at least one reading apparatus 174 which is designed to read the use information from the cleaning device 110, in particular from the controller 157. To this end, the reading apparatus 174 can comprise, for example, at least one interface 176 which can communicate, for example, with the data interface 164 of the cleaning device 110. Furthermore, the reading apparatus 174 can comprise different types of user interfaces 178.

In addition, the reading apparatus 174 can further comprise at least one cost calculation device 180, for example once again as a component of a processor 182 and/or as a software program which can be executed on the processor 182. The cost calculation device 180 is designed to assign at least one use fee to the read-out use information. However, as an alternative, the reading apparatus 174 can also simply be designed for reading out the utilization variable, for example by service personnel, and then, for example when returned to the supplier, to calculate a use fee there from the use information or to use the use information in another way, for example for determining servicing intervals on the basis of actual use.

It should be noted that, in this exemplary embodiment of the cleaning system 172, the reading apparatus 174 can be configured, by way of example, as a handheld apparatus. However, this is not necessarily the case. Therefore, the reading apparatus 174 can be, for example, a computer which is connected to the cleaning device 110 via a computer network, and therefore the utilization information can also be read out online for example. Various configurations are feasible.

The above-described examples of detecting utilization variables and the assignment thereof can be configured with any desired complexity. A further option for the configuration involves, for example, the cleaning device 110 comprising a GPS device 184 as a further sensor. This GPS device 184 can determine, for example, the location of the cleaning device 110. Information of this kind can also be of interest for a utilization. Therefore, a single-chamber dishwasher 112 specifically, as illustrated in FIG. 1, can be easily transported for example. However, different tariffs for calculating a use fee can apply for different users. This can be taken into account, for example, by the location being detected as an additional utilization variable and, for example depending on the installation site, weightings being assigned differently in method step 220. For example, the location can be incorporated in the assignment by a tariff factor or a tariff table or, as an alternative, different formulae and/or different tables can be employed depending on the installation site.

The cleaning device 110 is configured as a single-chamber dishwasher 112 in FIG. 1 by way of example. However, this is not necessarily the case, as will be explained by way of example with reference to FIG. 3. Therefore, as an alternative or in addition, other types of cleaning devices, for example for the care sector or else dishwashers of a larger size, can also be configured according to the invention. FIG. 3 shows, in turn, a sectional illustration of an example of a cleaning device 110 and a cleaning system 172.

In FIG. 3, the cleaning device 110 is configured as a pass-through dishwasher 312 and has a transportation device 314 by means of which articles 116 to be cleaned, for example dishes, can be transported through a cleaning chamber 114 of the cleaning device 110. For example, the cleaning device 110 can be configured as a rack conveyor washer and can be designed to transport the articles 116 to be cleaned in transportation racks 316, or can be configured as a flight-type washer in which the articles 116 to be cleaned are transported directly on a conveyor belt, as shown in this exemplary embodiment.

The articles 116 to be cleaned can be transported from a feed zone 320 to a discharge zone 322 in a transportation direction 318 by means of the transportation device 314. In this case, the cleaning chamber 114 can be subdivided into a plurality of zones, wherein a pre-clearing zone 324, a wash zone 326 and a final rinse zone 328 can be provided for example. Furthermore, at least one drying zone 330, in which the articles 116 which have been cleaned are dried by means of a fan 332, can be provided following said zones.

The zones 324, 326 and 328 can be referred to, in general, as washing zones 334 within which application devices 336, in the form of nozzle systems with nozzles 123, can be provided to apply at least one cleaning fluid 118 to the articles 116 to be cleaned.

Therefore, a pre-clearing nozzle system 338, which is fed with liquid from a pre-clearing tank 342 by means of a pre-clearing pump 340, can be provided in the pre-clearing zone 324. A wash zone nozzle system 344, which can be fed with liquid from a wash tank 348 by means of a wash zone pump 346, can be provided in the wash zone 326. The final rinse zone 328 can have a pump final rinse arrangement 350 and also a fresh water final rinse arrangement 352 which follows in the transportation direction 318. The pump final rinse arrangement 350 has a pump final rinse nozzle system 354, and the fresh water final rinse arrangement 352 has a fresh water final rinse nozzle system 356. Whereas the pump final rinse nozzle system 354 is fed with liquid from a final rinse tank 358 by means of a final rinse pump 360, the fresh water final rinse nozzle system 356 is fed with fresh water from a building-side fresh water connection 364 via a fresh water supply line 362. The fresh water supply line 362 can comprise, for example, a temperature control device 153 in the form of a heating device 366 by means of which the supplied fresh water can be heated up, for example to a temperature of from 80° C. to 100° C., preferably to a temperature of at least 85° C. The fresh water supply line 362 can optionally be routed via at least one heat recovery device 368 in which waste heat from the cleaning device 110 can be used in order to heat up supplied fresh water.

The articles 116 to be cleaned can be continuously or discontinuously passed through the washing zones 334 by means of the transportation device 314, before the articles 116 which have been cleaned are dried in the drying zone 330. The washing zones 334 can each be closed off by partition curtains 370.

The cleaning device 110 preferably uses several types of cleaning fluid 118 in the form of washing liquids which are preferably all aqueous washing liquids. For example, fresh water is preferably used as washing liquid in the fresh water final rinse arrangement 352, optionally with added final rinse aid. In the fresh water final rinse arrangement 352, the washing liquid only once comes into contact with the articles 116 to be cleaned. In the pump final rinse arrangement 350 however, final rinse liquid from the final rinse tank 358 is applied in a circulation mode to the articles 116 to be cleaned. In the wash tank 348, detergent, for example detergent solution, can be added to the washing liquid for example. In the wash zone 326, the articles 116 to be cleaned can be cleaned in circulation mode with the washing liquid from the wash tank 348. In the pre-clearing zone 324, the articles 116 to be cleaned can be acted on in circulation mode.

As discussed above, one or more wash-active substances can each be admixed to the cleaning fluid 118 in the form of the washing liquids in the tanks 342, 348 and 358. To this end, one or more metering devices, which are not shown in FIG. 3, can be provided. For example, a metering device can optionally be provided on the fresh water supply line 362, it being possible for a final rinse agent and/or a disinfectant to be supplied to the fresh water final rinse arrangement 352 by means of said fresh water supply line. The connection of the at least one metering point can be, for example, in front of and/or behind the heating device. As an alternative or in addition, a metering device can be provided on the final rinse tank 358, it being possible for a final rinse agent and/or a disinfectant to be metered into the final rinse tank 358 by means of said metering device. By way of example, at least one metering device, by means of which one or more detergents can be metered into the wash tank 348, can optionally be provided in the wash zone 326. As an alternative or in addition, at least one metering device, by means of which at least one detergent can be metered into the pre-clearing tank 342, can be provided in the pre-clearing zone 324. The metering devices can be realized individually, in pairs or in said combinations. However, a different arrangement, combination and type of metering are also possible in principle.

Furthermore, in the illustrated arrangement, the cleaning device 110 once again has a controller 157 which can be configured, for example, analogously to the controller in FIG. 1. Said controller may be, for example, a centralized machine controller which can, however, also be configured in a decentralized manner. For example, one or more cleaning programs in the cleaning device 110 can be controlled by means of the at least one controller 157. The controller 157 can be connected, in particular, to at least one supply valve 372, which can control a fresh water supply, and/or to one or more of said metering devices and can actuate these elements. Furthermore, the controller 157 can be, for example, entirely or partially connected to the pumps 340, 346 and 360 and can actuate these pumps. Furthermore, the controller 157 can be connected, for example, to the at least one transportation device 314 and can control the transportation device 314. The controller 157 can be configured, for example, entirely or partially as a regulation device and/or can comprise at least one regulation arrangement. The controller 157 once again comprises, for example analogously to the configuration according to FIG. 1, a counting device 170 which can, for example, entirely or partially comprise the processor 158 and the data memory 160, can be entirely or partially designed as a hardware and/or software component or can also be designed separately.

The controller 157 is once again designed to detect one or more utilization parameters which can comprise, for example, one or more operating parameters. Therefore, the cleaning device 110, as in the exemplary embodiment according to FIG. 1, can generate, for example, one or more utilization parameters by setting a specific program and/or in the form of one or more setpoint values for actuating the cleaning device 110, for example setpoint values for pump rotation speeds. However, as an alternative or in addition, one or more utilization parameters can once again, as in the exemplary embodiment according to FIG. 1, be detected using sensors. Therefore, the cleaning device 110 can once again, as in FIG. 1 too, have one or more sensors for detecting one or more operating parameters. Therefore, the cleaning device 110 can have, for example, one or more sensors for detecting a pressure with which the articles to be cleaned are acted on, or a volume flow sensor for detecting the flow of a cleaning fluid. As an alternative or in addition, the cleaning device 110 can have, for example, one or more sensors for detecting a supply and/or a concentration of one or more components of the washing liquid. In general, the sensors can be directly or indirectly connected to the at least one controller 157. Therefore, the cleaning device 110 can have, for example, at least one flow meter for detecting a volume flow and/or mass flow of a supply of fresh water. As an alternative or in addition, the cleaning device 110 can also have one or more sensors in the tanks 342, 348 and 358. For example, turbidity sensors and/or conductivity sensors, by means of which a detergent concentration and/or a degree of soiling can be detected for example, can be provided there. In order to regulate a supply of one or more components of the washing liquids of the cleaning device 110, for example in order to regulate a fresh water supply and/or to regulate metering of detergent, the controller 157 can comprise, for example, one or more regulators which can be implemented, for example, in the form of software and/or in the form of hardware. These regulators can detect one or more actual values, for example by means of the sensors and/or by means of a flow meter, and can adjust a supply to at least one setpoint value, for example by means of said metering devices and/or the supply valve 372.

A similar method to that described above with reference to the example in FIG. 2 can be carried out by means of the cleaning device 110 in principle. However, the utilization variables in the cleaning device 110 according to FIG. 3 can be of considerably more complex configuration since there are considerably more actuating variables in the cleaning device 110 according to FIG. 3. For example, a transportation speed, a plurality of tank temperatures, further pump rotation speeds or fluid pressures of the individual washing zones 334, a heating power of the fan 332 and/or an air output of said fan or other parameters can be used as further operating parameters. Furthermore, throughput parameters can also be used here, for example a number of transportation racks 316 per unit of time or a total number of transportation racks 316, can also be used here. Various configurations are possible.

FIG. 3, in turn, also illustrates an example of a cleaning system 172 which, in addition to the cleaning device 110, comprises a reading apparatus 174. This at least one reading apparatus 174 can once again, by way of example, be configured as a handheld apparatus or else as a stationary apparatus. In the case of fixed installation of the cleaning device 110, it is possible, for example, to use a fixed network or else a mobile network as the means for transmitting use information.

LIST OF REFERENCE NUMERALS

110 Cleaning device
112 Single-chamber dishwasher
114 Cleaning chamber
116 Articles to be cleaned
118 Cleaning fluid
120 Application device
122 Washing nozzle system
123 Nozzles
124 Rinse nozzle system
125 Spray arms
126 Rack
128 Door
130 Washing line
132 Washing pump
134 3-way valve
136 Washing tank
138 Rinse line
140 Rinse valve
142 Rinse pump
144 Rinse tank
146 Fresh water supply line
148 Discharge line
150 Discharge pump
152 Outlet
153 Temperature control device
154 Heating element
156 Further heating element
157 Controller
158 Processor
160 Data memory
162 User interface
164 Data interface
166 Temperature sensor
168 Temperature sensor
170 Counting device
172 Cleaning system
174 Reading apparatus
176 Interface
178 User interface
180 Cost calculation device
182 Processor
184 GPS device
210 Start
212 Read value $N(t_0)$ from memory, set $t=t_0$, $N(t)=n(t_0)$
214 Query: is a maintenance process being carried out?
216 Subtract bonus
218 Detect utilization variables
220 Assign weighting
222 Increment the use information for time interval $\Delta t$
224 Wait for time interval $\Delta t$
226 Termination?
228 Write current value for use information into memory
312 Pass-through dishwasher
314 Transportation device
316 Transportation rack
318 Transportation direction
320 Feed zone
322 Discharge zone
324 Pre-clearing zone
326 Wash zone
328 Final rinse zone
330 Drying zone
332 Fan
334 Washing zone
336 Application device
338 Pre-clearing nozzle system
340 Pre-clearing pump
342 Pre-clearing tank
344 Wash zone nozzle system
346 Wash zone pump
348 Wash tank
350 Pump final rinse arrangement
352 Fresh water final rinse arrangement
354 Pump final rinse nozzle system
356 Fresh water final rinse nozzle system
358 Final rinse tank
360 Final rinse pump
362 Fresh water supply line
364 Fresh water connection
366 Heating device
368 Heat recovery device
370 Partition curtains
372 Supply valve

The invention claimed is:

1. A cleaning device for cleaning articles to be cleaned, comprising at least one cleaning chamber and at least one application device for applying at least one cleaning fluid to the articles to be cleaned in the cleaning chamber, further comprising at least one controller, wherein the controller is designed to actuate the cleaning device for carrying out at least two operating modes, wherein the controller is further designed to detect at least one utilization variable, wherein the utilization variable characterizes a current utilization of the cleaning device, wherein the controller is further designed to assign at least one weighting to the at least one utilization variables, wherein the controller further has at least one counting device, wherein the counting device is designed to cumulate utilization times of the cleaning device which are weighted with the weighting and to generate at least one item of use information about a use of the cleaning device therefrom.

2. The cleaning device as claimed in claim 1, wherein the cleaning device is selected from the group consisting of: a single-chamber dishwasher; a pass-through dishwasher; a hood-type dishwasher; a conveyor dishwasher; a cleaning and disinfection apparatus; and a cleaning device for one or both cleaning and/or disinfecting personal protection equipment.

3. The cleaning device as claimed in claim 1, wherein the controller is designed to detect the utilization times in accordance with a time detection mode, wherein the time detection mode is selected from the group consisting of: a continuous time detection operation; a cumulative time detection operation in discrete time intervals; and a cumulative time detection operation in discrete utilization cycles.

4. The cleaning device as claimed in claim 1, wherein the controller is designed to carry out the assignment of the weighting by means of one or both of at least one assignment algorithm and at least one assignment table.

5. The cleaning device as claimed in claim 1, wherein the utilization variable comprises at least one operating parameter of the cleaning device, which operating parameter is detected by the controller, or is ascertained by means of at least one operating parameter of the cleaning device, which operating parameter is detected by the controller.

6. The cleaning device as claimed in claim 5, wherein the at least one operating parameter is selected from the group consisting of: a temperature of the at least one cleaning fluid; and a level of media consumption.

7. The cleaning device as claimed in claim 1, wherein the counting device is designed to determine the use information in accordance with at least one algorithm selected from the group consisting of:

$$N(T)=c\cdot\int_T f(p_1, \ldots, p_n)dt \quad \text{i)}$$

$$N(T)=c\cdot\Sigma_i f(p_1, \ldots, p_n)\cdot\Delta t_i \quad \text{ii)}$$

$$N(T)=c\cdot\int_T f(p_1, \ldots, p_n)dt-B(T) \quad \text{iii)}$$

$$N(T)=c\cdot\Sigma_i f(p_1, \ldots, p_n)\cdot\Delta t_i-B(T) \quad \text{iv)}$$

where

N(T) is a current value of the use information at time T, c is a calibration coefficient, T is an observation time at which the use information is intended to be determined, $p_i, \ldots, p_n$ are utilization variables of the cleaning device, f is a weighting function which is dependent on at least one utilization variable $p_i$, i is a running variable over all detected discrete use intervals, and B(T) is a bonus function which takes into account at least one performance of at least one maintenance process of the cleaning device.

8. The cleaning device as claimed in claim 7, wherein the weighting function is a linear combination of at least two utilization variables which are weighted with weighting factors $b_j$:

$$f(p_1, \ldots, p_n) = \sum_{j=1}^{n} b_j \cdot p_j$$

9. The cleaning device as claimed in claim 1, wherein the controller is further designed in such a way that the at least one utilization variable comprises one or both of at least one service life and at least one standby time of the cleaning device.

10. The cleaning device as claimed in claim 1, wherein the controller is further designed to detect performance of at least one maintenance process, wherein the counting device is designed to take into account the maintenance process when generating the use information.

11. The cleaning device as claimed in claim 10, wherein the controller is designed to take into account the maintenance process with an opposite mathematical sign in relation to a regular use in the use information.

12. The cleaning device as claimed in claim 10, wherein the maintenance process comprises at least one element selected from the group consisting of: a self-cleaning cycle; a use of a maintenance medium; a routine cleaning operation; and a servicing operation of the cleaning device.

13. A cleaning system for cleaning articles to be cleaned, comprising at least one cleaning device as claimed in claim 1, further comprising at least one reading apparatus, wherein the reading apparatus is designed to read out the use information from the cleaning device.

14. The cleaning system as claimed in claim 13, wherein the reading apparatus is designed separately from the cleaning system and can be connected to the cleaning device via at least one interface.

15. The cleaning system as claimed in claim 13, wherein the reading apparatus further has at least one cost calculation device, wherein the cost calculation device is designed to assign at least one use fee to the read-out use information.

16. A method for operating a cleaning device for cleaning articles to be cleaned, wherein the cleaning device has at least one cleaning chamber and at least one application device for applying at least one cleaning fluid to the articles to be cleaned in the cleaning chamber, wherein the method comprises the following steps:

a) detecting at least one utilization variables of the cleaning device, wherein the utilization variable characterizes a current use of the cleaning device;

b) assigning at least one weighting to the at least one utilization variable;

c) generating at least one item of use information about a use of the cleaning device from a cumulation of the utilization times of the cleaning device which are weighted with the weighting.

17. The method as claimed in claim 16, wherein a cleaning device as claimed in claim 1, is used.

18. The method as claimed in claim 16, wherein the method steps a) to c) are carried out using at least one computer or computer program.

19. A computer program comprising program code for carrying out the method as claimed in claim 16.

20. The use of a cleaning device as claimed in claim 1, for use-dependent calculation of a utilization fee for the cleaning device.

21. The cleaning device as claimed in claim 1, wherein the cleaning device is a dishwasher.

22. The cleaning device as claimed in claim 6, wherein the level of consumption of at least one medium is selected from the group consisting of: water or a detergent; a switch-on period of at least one consumer of the cleaning device; a rotation speed of at least one nozzle arm of the application device; a property of at least one cleaning fluid; a type of one or both of the at least one cleaning fluid; a component of the at least one cleaning fluid; a heating power of at least one heating element of the cleaning device; an electrical energy intake of the cleaning device; a rotation speed of at least one pump; a number of pump revolutions; a pressure with which the articles to be cleaned are acted on; a volume flow which is sprayed by means of the application device; a door operation of at least one door of the cleaning device; a transportation parameter of at least one transportation device of the cleaning device; a transportation distance per unit of time; an absolute transportation distance; a quantity of articles to be cleaned; a quantity of transportation racks for articles to be cleaned; a throughput of articles to be cleaned; a type of a selected cleaning program;

a quantity of cleaning fluid in at least one fluid tank of the cleaning device; a vibration of the cleaning device; an ambient temperature of the cleaning device; a type of at least one article to be cleaned which is cleaned in the cleaning device; a quantity of at least one article to be cleaned which is cleaned in the cleaning device; a material of at least one article to be cleaned which is cleaned in the cleaning device; a degree of soiling of at least one article to be cleaned which is cleaned in the cleaning device; and a location of the cleaning device.

23. The cleaning device as claimed in claim 22, wherein the property of at least one cleaning fluid is selected from the group consisting of: one or both of a pH value, a hardness of at least one cleaning fluid; and one or both of a pH value and a hardness of water which is used in the cleaning fluid.

24. The cleaning device as claimed in claim 22, wherein the transportation parameter of at least one transportation device of the cleaning device is a transportation speed.

25. The cleaning device as claimed in claim 12, wherein the maintenance medium is one or both of a water softener and a descaler.

* * * * *